US011457688B2

(12) United States Patent
Baines et al.

(10) Patent No.: US 11,457,688 B2
(45) Date of Patent: Oct. 4, 2022

(54) UPPER FOR AN ARTICLE OF FOOTWEAR HAVING AN INNER COMPONENT AND A SHROUD

(71) Applicant: NIKE, Inc., Beaverton, OR (US)

(72) Inventors: Simon J. Baines, Beaverton, OR (US); Lauren K. Tyndall, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 52 days.

(21) Appl. No.: 16/516,699

(22) Filed: Jul. 19, 2019

(65) Prior Publication Data

US 2020/0022450 A1 Jan. 23, 2020

Related U.S. Application Data

(60) Provisional application No. 62/701,325, filed on Jul. 20, 2018.

(51) Int. Cl.
*A43B 1/04* (2022.01)
*A43B 23/02* (2006.01)
(Continued)

(52) U.S. Cl.
CPC ..... *A43B 5/02* (2013.01); *A43B 1/04* (2013.01); *A43B 5/025* (2013.01); *A43B 23/025* (2013.01); *A43B 23/026* (2013.01); *A43B 23/0235* (2013.01); *A43C 1/04* (2013.01); *A43C 7/02* (2013.01)

(58) Field of Classification Search
CPC ..... A43B 1/04; A43B 5/025; A43B 23/0235; A43B 23/028; A43C 1/04; A43C 7/02
See application file for complete search history.

(56) References Cited

U.S. PATENT DOCUMENTS 3,599,351 A 8/1971 Check
5,337,491 A 8/1994 Mascotte
(Continued)

FOREIGN PATENT DOCUMENTS

CN 102379477 3/2012
CN 106535690 A 3/2017
(Continued)

OTHER PUBLICATIONS

International Search Report and Written Opinion dated Oct. 24, 2019 for PCT Application No. PCT/CN2019/042550, 17 pages.
(Continued)

*Primary Examiner* — Sharon M Prange
(74) *Attorney, Agent, or Firm* — Shook Hardy & Bacon L.L.P.

(57) ABSTRACT

An upper for an article of footwear may include a medial side, a lateral side, and a throat area between the medial side and the lateral side. An inner component may form an inner surface of the upper, where the inner component includes an inner throat region in the throat area, where a tensile strand of the inner component forms a loop in the inner throat region, and where the loop includes an opening for receiving a fastening element. An outer shroud may form the outer surface of the upper, where the outer shroud at least partially covers the inner throat region of the inner component such that the loop is located in a pocket formed between the inner component and the outer shroud.

17 Claims, 5 Drawing Sheets

(51) Int. Cl.

| | |
|---|---|
| ***A43C 1/04*** | (2006.01) |
| ***A43B 5/02*** | (2006.01) |
| ***A43C 7/02*** | (2006.01) |

(56) References Cited

U.S. PATENT DOCUMENTS

| | | | | |
|---|---|---|---|---|
| 6,754,983 | B2 | 6/2004 | Hatfield et al. | |
| 6,986,269 | B2 | 1/2006 | Dua | |
| 7,155,846 | B2 | 1/2007 | Alfaro et al. | |
| 7,320,189 | B2 | 1/2008 | Clark et al. | |
| 7,444,768 | B2 | 11/2008 | Friton | |
| 8,584,378 | B2 | 11/2013 | Weidl et al. | |
| 8,839,532 | B2 | 9/2014 | Huffa et al. | |
| 8,869,435 | B2 * | 10/2014 | Hatfield | A43B 5/001 36/102 |
| 9,192,204 | B1 * | 11/2015 | Liles | A43B 23/0245 |
| 9,210,966 | B2 | 12/2015 | Bell et al. | |
| 9,498,023 | B2 | 11/2016 | Craig | |
| 9,820,526 | B2 | 11/2017 | Poshedley, III | |
| 10,076,152 | B2 | 9/2018 | Panian et al. | |
| 10,182,617 | B2 * | 1/2019 | Craig | A43B 1/04 |
| 10,631,594 | B2 * | 4/2020 | Boucher | A43B 23/0215 |
| 2012/0023778 | A1 | 2/2012 | Dojan et al. | |
| 2012/0233882 | A1 * | 9/2012 | Huffa | A43B 23/025 36/45 |
| 2014/0130270 | A1 | 5/2014 | Baudouin et al. | |
| 2014/0137434 | A1 | 5/2014 | Craig | |
| 2014/0237856 | A1 * | 8/2014 | Podhajny | D04B 1/123 36/84 |
| 2015/0059209 | A1 | 3/2015 | Dekovic et al. | |
| 2015/0257476 | A1 * | 9/2015 | Panian | A43B 23/07 36/114 |
| 2015/0313316 | A1 | 11/2015 | Boucher et al. | |
| 2015/0342261 | A1 | 12/2015 | Boucher et al. | |
| 2016/0262528 | A1 | 9/2016 | Telwar | |
| 2017/0202311 | A1 * | 7/2017 | Klug | A43B 23/0275 |
| 2017/0208900 | A1 | 7/2017 | Boucher et al. | |
| 2017/0280817 | A1 * | 10/2017 | Hutchinson | A43B 1/04 |
| 2017/0311672 | A1 | 11/2017 | Hipp et al. | |
| 2018/0168271 | A1 | 6/2018 | Ly | |
| 2019/0116932 | A1 * | 4/2019 | Bell | A43B 19/00 |
| 2019/0116933 | A1 * | 4/2019 | Cook | A43B 1/14 |

FOREIGN PATENT DOCUMENTS

| | | |
|---|---|---|
| EP | 1486131 | 12/2004 |
| GB | 24208 A | 4/1915 |

OTHER PUBLICATIONS

International Preliminary Report on Patentability received for PCT Patent Application No. PCT/US2019/042550, dated Feb. 4, 2021, 11 pages.

Office Action received for European Patent Application No. 19749917.1, dated May 19, 2021, 4 pages.

Intention to Grant received for European Patent Application No. 19749917.1, dated Oct. 19, 2021, 5 pages.

Extended European Search Report received for European Patent Application No. 21212344.2, dated Jan. 25, 2022, 10 pages.

* cited by examiner

UPPER FOR AN ARTICLE OF FOOTWEAR HAVING AN INNER COMPONENT AND A SHROUD

RELATED APPLICATIONS

This application claims the benefit of U.S. Provisional Application No. 62/701,325, filed Jul. 20, 2018, which is hereby incorporated by reference in its entirety.

TECHNICAL FIELD

The present disclosure relates to an upper for an article of footwear and methods of manufacture of such an upper.

BACKGROUND

Conventional articles of footwear generally include two primary elements: an upper and a sole structure. The upper is secured to the sole structure and forms a void within the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the cavity on the interior of the upper is generally provided by an ankle opening, a.k.a. throat opening, in a heel region of the footwear. A lacing or Velcro system is often incorporated into the exterior of the upper to adjust the geometry of the upper, thereby permitting entry and removal of the foot from the cavity within the upper. The lacing or Velcro system also permits the wearer to modify certain dimensions of the upper, particularly girth, to accommodate feet with varying dimensions. In addition, the upper may include a tongue that extends under the lacing system to enhance adjustability of the footwear. A shoe tongue is a strip of leather or other material located under the laces or Velcro of a shoe. The tongue sits on the top center part of the shoe on top of the bridge of the foot. It is generally attached to the vamp and runs all the way to the throat of the shoe.

BRIEF DESCRIPTION OF DRAWINGS

The embodiments described herein may be better understood with reference to the following drawings and description. The components in the figures are not necessarily to scale. Moreover, in the figures, like-referenced numerals designate corresponding parts throughout the different views.

DETAILED DESCRIPTION

Figure 1:
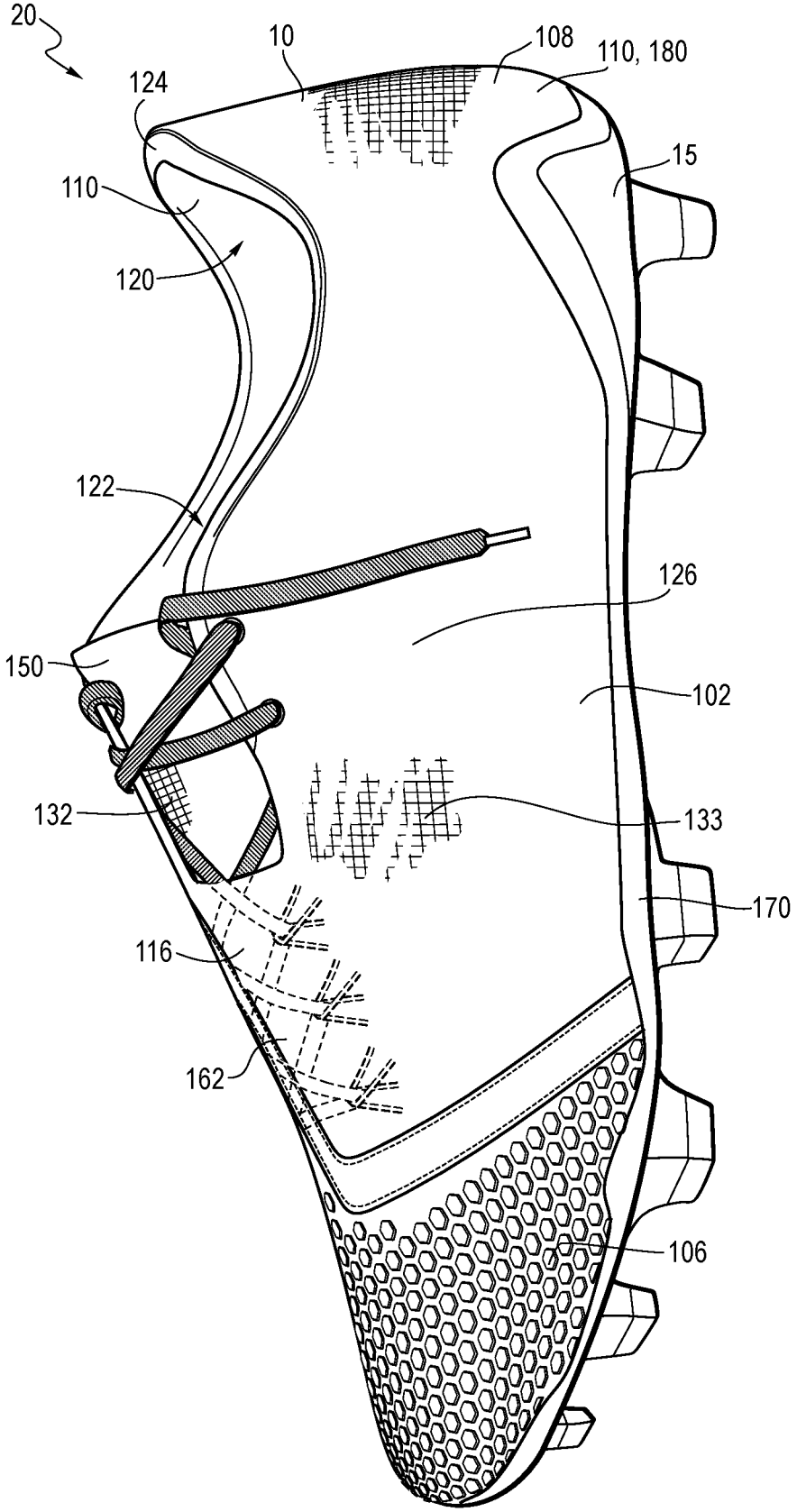
FIG. 1 is an illustration showing a lateral-side view of an article of footwear having an upper and a sole structure, where the upper includes an inner component and an outer shroud in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances, details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

In one aspect, the present disclosure provides an upper for an article of footwear that includes a medial side, a lateral side, and a throat area between the medial side and the lateral side. An inner component may form an inner surface of the upper, where the inner component includes an inner throat region in the throat area, where a tensile strand of the inner component forms a loop in the inner throat region, and where the loop includes an opening for receiving a fastening element. An outer shroud may form the outer surface of the upper, where the outer shroud at least partially covers the inner throat region of the inner component such that the loop is located in a pocket formed between the inner component and the outer shroud. The upper may further, or alternatively, include any other compatible feature, such as those described in this description.

In another aspect, the present disclosure provides an upper for an article of footwear that may include an inner component forming an inner surface of the upper, where the inner component includes an inner throat region in a throat area of the upper. An outer shroud forming an outer surface of the upper may at least partially cover the inner throat region of the inner component such a pocket is formed between the inner component and the outer shroud. A fastening element may be included, where the fastening element extends through an opening of the inner component, and where the opening is located within the pocket. The upper may further, or alternatively, include any other compatible feature, such as those described in this description.

In another aspect, the present disclosure provides a method that includes knitting loops of an inner component of an upper, where the inner component forms an inner surface of the upper, and where the inner component includes an inner throat region in a throat area of the upper. The method may further include inlaying a tensile strand within the loops of the inner component, where the inner component forms a loop in the inner throat region. The method may further include securing an outer shroud to the inner component, where the outer shroud forms an outer surface of the upper, and where the outer shroud least partially covers the inner throat region of the inner component such that the loop is located in a pocket formed between the inner component and the outer shroud. The upper may further, or alternatively, include any other compatible feature, such as those described in this description, and any suitable method step may be included for forming an upper with such features.

Figure 2:
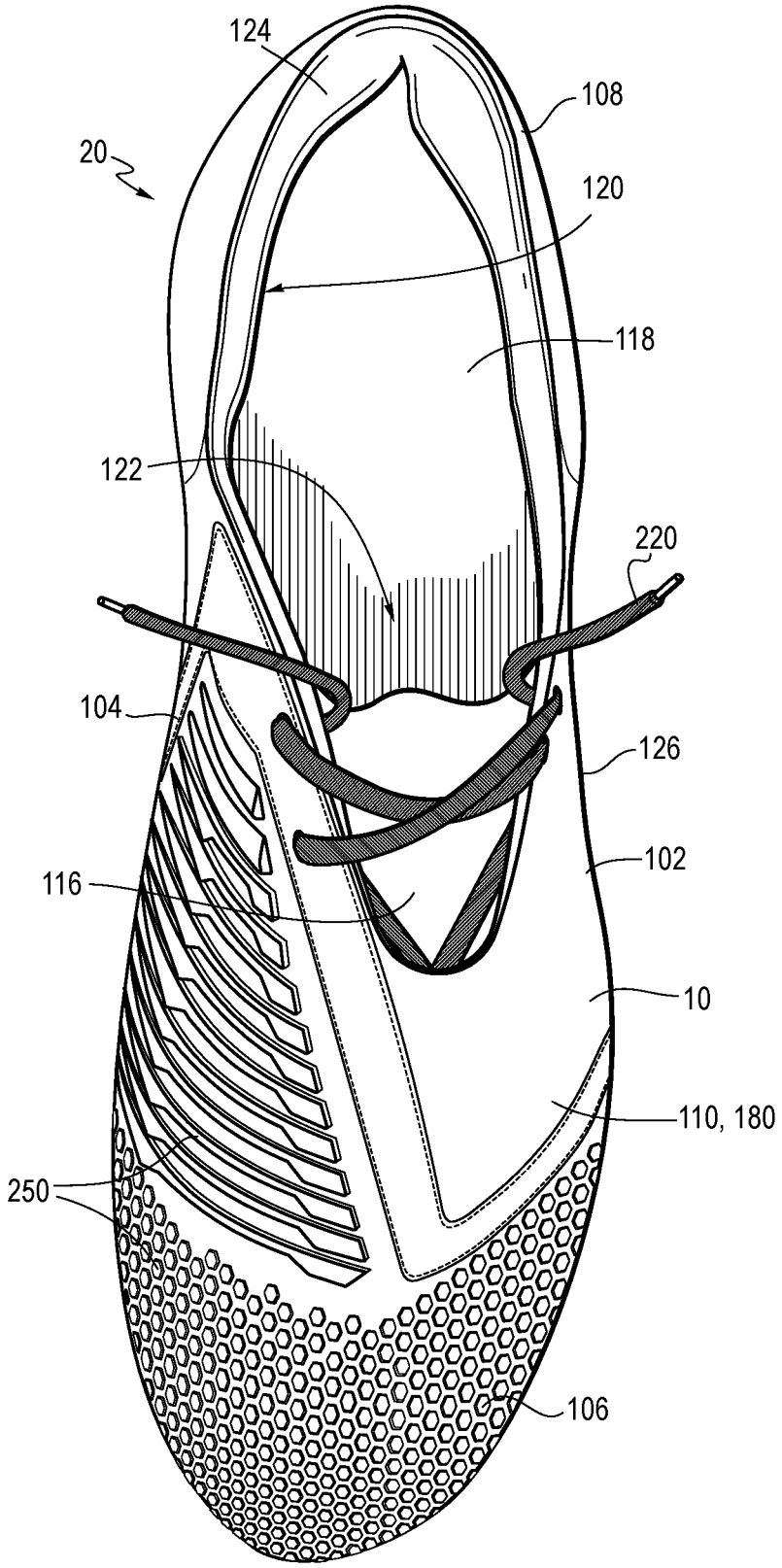
FIG. 2 is an illustration showing a top view of the article of footwear depicted in FIG. 1.

FIG. 1 and FIG. 2 are illustrations respectively depicting a lateral-side view and a top view of an example of an article of footwear 20. As shown, the article of footwear 20 may generally include an upper 10 that is secured to a sole structure 15. The area where the sole structure 15 joins the upper 10 may be referred to as a biteline 170. The upper 10 may be joined to the sole structure 15 in a fixed manner using any suitable technique, such as through the use of an adhesive, by sewing, etc. The upper 10 may extend partially or completely around a foot of a wearer (e.g., under the foot in some embodiments), and the sole structure 15 may cover at least the dorsal surface (e.g., bottom) of the wearer's foot. In some embodiments, the sole structure 15 may include a midsole and an outsole.

The upper 10 may include a lateral side 102, a medial side 104, a toe area 106, and a heel area 108. The upper 10 may additionally include a throat area 116 extending from an ankle opening 118 leading to a void 122, and a collar 124 may at least partially surround the ankle opening 118. The void 122 of the article of footwear 20 may be configured (e.g., sized and shaped) to receive and accommodate a foot of a person. The throat area 116 may be generally disposed in a midfoot area 126 of the upper 10, which may be located between the heel area 108 and a toe area 106.

The upper 10 may include an inner component 100 forming an inner surface 120 of the upper 10 and an outer shroud 110 forming an outer surface of the upper 10. In some embodiments, at least one of the inner component 100 and the outer shroud 110 may include a knitted component 132 and/or 133. For example, in the depicted embodiment, the inner component 100 is depicted as being formed substantially, or completely, of a knitted component 132, but alternatively it may be at least partially formed of another non-knit material. For example, the inner component 100 may alternatively or additionally formed with textile materials formed by a process other than knitting (e.g., weaving) and/or other materials, such as leather, plastic, rubber, etc. The outer shroud 110 is depicted as being formed of a non-knit material in the present figures, but in other embodiments the outer shroud 110 may be partially or fully formed of a knitted component.

Forming the inner component 100 and/or the outer shroud 110 with a knitted component may provide the upper 10 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. Forming the upper 10 (e.g., the inner component 100 and/or the outer shroud 110) at least partially with knitted material may also provide desirable aesthetic characteristics by incorporating yarns having different colors, textures or other visual properties arranged in a particular pattern.

The inner component 100 and/or the outer shroud 110 may be formed as an integral one-piece element during a single knitting process, such as a weft knitting process (e.g., with a flat knitting machine or circular knitting machine), a warp knitting process, or any other suitable knitting process. That is, the knitting process on the knitting machine may substantially form the knit structure of inner component 100 and/or the outer shroud 110 without the need for significant post-knitting processes or steps. Alternatively, two or more portions of the inner component 100 and/or the outer shroud 110 may be formed separately as distinct integral one-piece elements and then the respective elements attached. In some embodiments (not shown), it is contemplated that a single knitted component may be included (e.g., where inner component 100 and/or the outer shroud 110 are combined as an integral one-piece element), and that single knitted component may form the majority of or the entirety of the upper 10. For example, if a multi-layer knitting technique is used, the inner component 100 may be defined by a first knit layer (e.g., formed on a first bed of a flat knitting machine), and the outer shroud 110 may be defined by a second knit layer (e.g., defined by a second layer formed on a second needle bed of a flat knitting machine). In other embodiments, it may be advantageous to form the inner component 100 and the outer shroud 110 separately such that, if formed on a knitting machine, the inner component 100 and/or the outer shroud 110 is formed alone using the full capacity of two needle beds of a knitting machine, thereby enhancing the ability for providing advanced knit structures (e.g. to provide certain mechanical and/or visual characteristics of the knitted material).

Further, the types of yarns used to form the inner component 100 (and/or the outer shroud 110 in other embodiments) may be varied at different locations such that the inner component 100 has areas with different properties (e.g., referring to FIG. 1, a portion forming the throat area 116 of the inner component 100 may be relatively elastic while another portion may be relatively inelastic, as described in more detail below).

The inner component 100, outer shroud 110, whether formed of knitted textiles or not, or both may be formed from a variety of materials. Such materials may be included in yarns (e.g., when knitted components are used as described above). For example, the inner component 100, outer shroud 110, or both may be formed from elastomeric materials, such as polyurethane containing polymer, spandex, lycra, polyester or polyether polyols that allow the region to stretch and then recover to its original shape. Polyester may be used in locations where the inner component 100 and/or the outer shroud 110 will contact the foot of a wearer, such as the inner surface 120, due to its comfort characteristics in combination with its suitable durability.

In some embodiments, the inner component 100, outer shroud 110, or both may be formed from thermoset polymeric materials and natural fibers, such as cotton, silk, wool, or polyester. When subjected to moderate levels of heat, thermoset polymeric materials tend to remain stable. Moreover, when subjected to elevated levels of heat, thermoset polymeric materials and natural fibers may burn or otherwise degrade or decompose. As such, thermoset polymeric materials generally always remain in a permanent solid state. In some aspects, the melting point or decomposition temperature of at least a portion of a yarn (or other element) used to form the inner component 100 and/or the outer shroud 110 is greater than about 140° C., based on one atmosphere pressure, such as greater than about 200° C., and such as greater than 250° C. or higher in certain embodiments.

Additionally or alternatively, in some embodiments, the inner component 100 may incorporate one or more materials with properties that change in response to a stimulus (e.g., temperature, moisture, electrical current, magnetic field, or light). For example, the inner component 100 may include yarns formed of one or more thermoplastic polymer materials (including material composites) that transition from a solid state to a softened or liquid state when subjected to certain temperatures at or above the melting point and then transitions back to a solid state when cooled. The thermoplastic polymer material(s) may provide the ability to heat and then cool a portion of the knitted material to thereby form an area of bonded or continuous material (herein referred to as a "fused area") that exhibits certain advantageous properties including a relatively high degree of rigidity, strength, and water resistance, for example. Non-limiting examples of thermoplastic polymer materials are polyurethanes, polyamides, polyolefins, and/or certain nylons.

Figure 3:
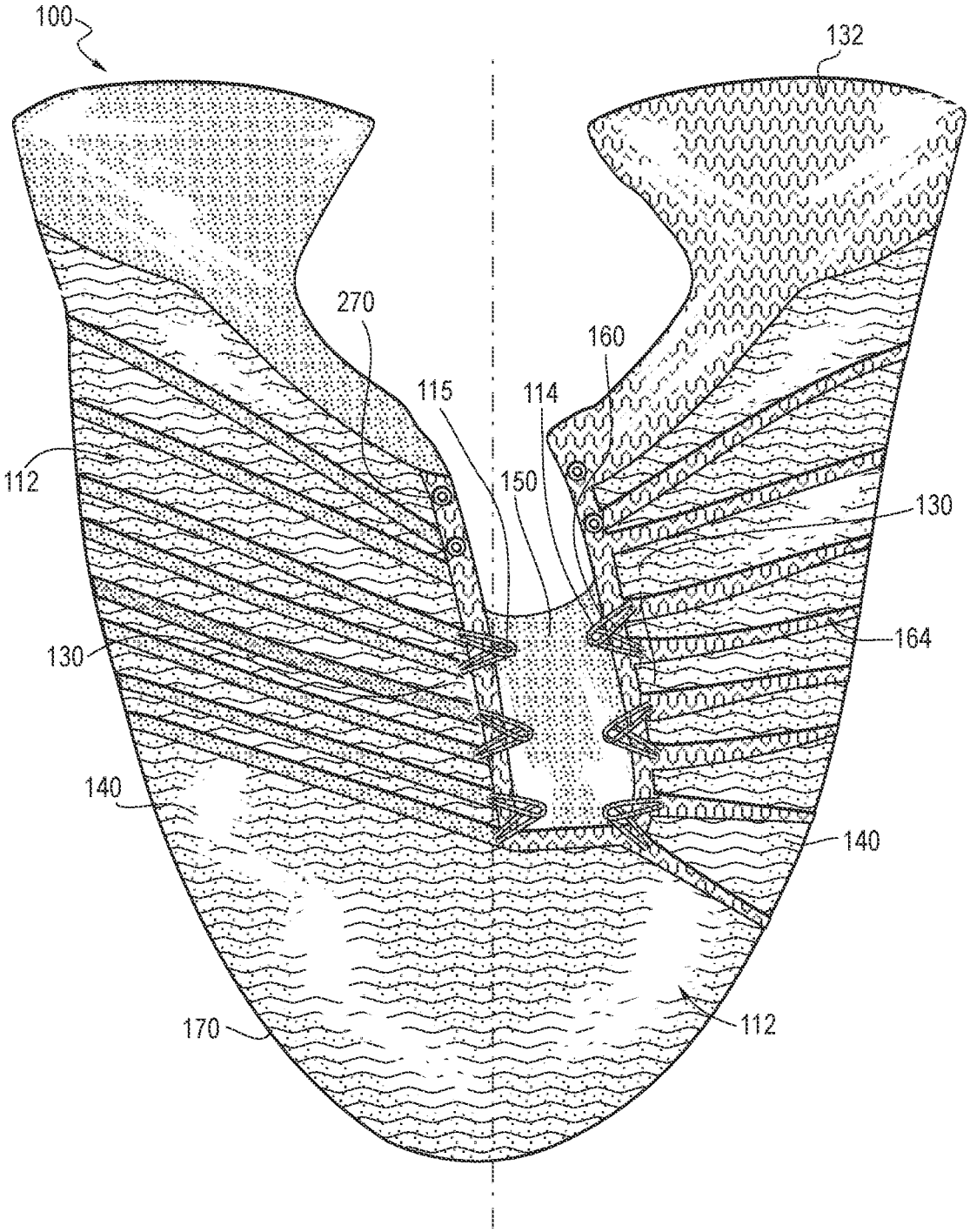
FIG. 3 is an illustration showing a top view of the inner component in isolation.

FIG. 3 is an illustration showing the inner component 100 in isolation. The inner component 100 may form an inner surface 120 (see FIG. 1) of the upper 10, where the inner surface 120 defines the void of the article of footwear. As shown in FIG. 3, the inner component 100 may have a second surface 112, located opposite the inner surface 120, having an inner medial region 130 and an inner lateral region 140. An inner throat region 150 may occupy a proximal portion of the inner medial region 130.

In some embodiments, a tensile strand 160 extends through the inner lateral region 140 of the inner component 100 to the inner throat region 150. Optionally, the tensile strand 160 may be included as a portion of the knitted component 132 (that is, formed on a knitting machine with the remainder of the inner component 100), or not. For example, if the tensile strand 160 is formed as a portion of the knitted component 132, it may be inlaid within the knitted component by a flat knitting machine such that the inlaid strand 160 extends between certain intermeshed loops of the knitted component 132. An inlaid strand and method of manufacturing is fully described in U.S. Pat. No. 8,839,532, which is hereby incorporated by reference in its entirety. For example, some intermeshed loops of the knitted component 132 may be on one side of the inlaid strand 160 and other intermeshed loops of the knitted component 132 may be on the opposite side of the inlaid strand 160 such that the inlaid strand 160 extends between two opposite-facing surfaces formed by the knitted component 132. In other embodiments, the tensile strand 160 may be assembled with the remainder of the inner component 100 after the knitting process. For example, the inner component 100 may include a set of channels 164 for receiving the tensile strand 160, and the tensile strand 160 may be deployed through the channels 164 as a post-knitting manufacturing step.

In some embodiments, portions of the tensile strand 160 may be at least partially exposed from the remainder of the inner component 100 (i.e., it may be exposed with respect to a surface of the inner component). For example, as shown in FIG. 3, a set of loops 114, which form openings 115 for receiving a shoe-fastening element, are exposed outside of the surface 120, extend out of the knitted component 132 adjacent to the throat region to form lace-receiving openings (as described in more detail below).

The tensile strand 160 may be a yarn, a cable, a rope, or any other type of strand. The tensile strand 160 may have any suitable elasticity, and in some embodiments it may have a substantially fixed length measured from a first end to a second end. In other words, the tensile strand 160 may be substantially inelastic. In other embodiments, an elastic tensile strand may additionally or alternatively be included.

Any suitable material may be used to form the tensile strand 160. For example, the tensile strand 160 may include a monofilament fiber and/or strands or fibers having a low modulus of elasticity as well as a high tensile strength including various filaments, fibers, and yarns, that are formed from rayon, nylon, polyester, polyacrylic, silk, cotton, carbon, glass, aramids (e.g., para-aramid fibers and meta-aramid fibers), ultra-high molecular weight polyethylene, and liquid crystal polymer. In some embodiments, a material forming most of the remainder of the upper 10 may elongate at least twice as much as the elongation of the tensile strand 160 when subjected to the same tensile force (e.g., such as a 5 pound force applied on a tensometer). Put another way, the Young's modulus of the tensile strand is at least twice as large as the Young's modulus of the material forming most of the remainder of the upper 10, where the Young's modulus is measured using the ASTM E111 standard test method for a material's Young's Modulus, measuring the rate of change of strain as a function of tensile stress.

Figure 4:
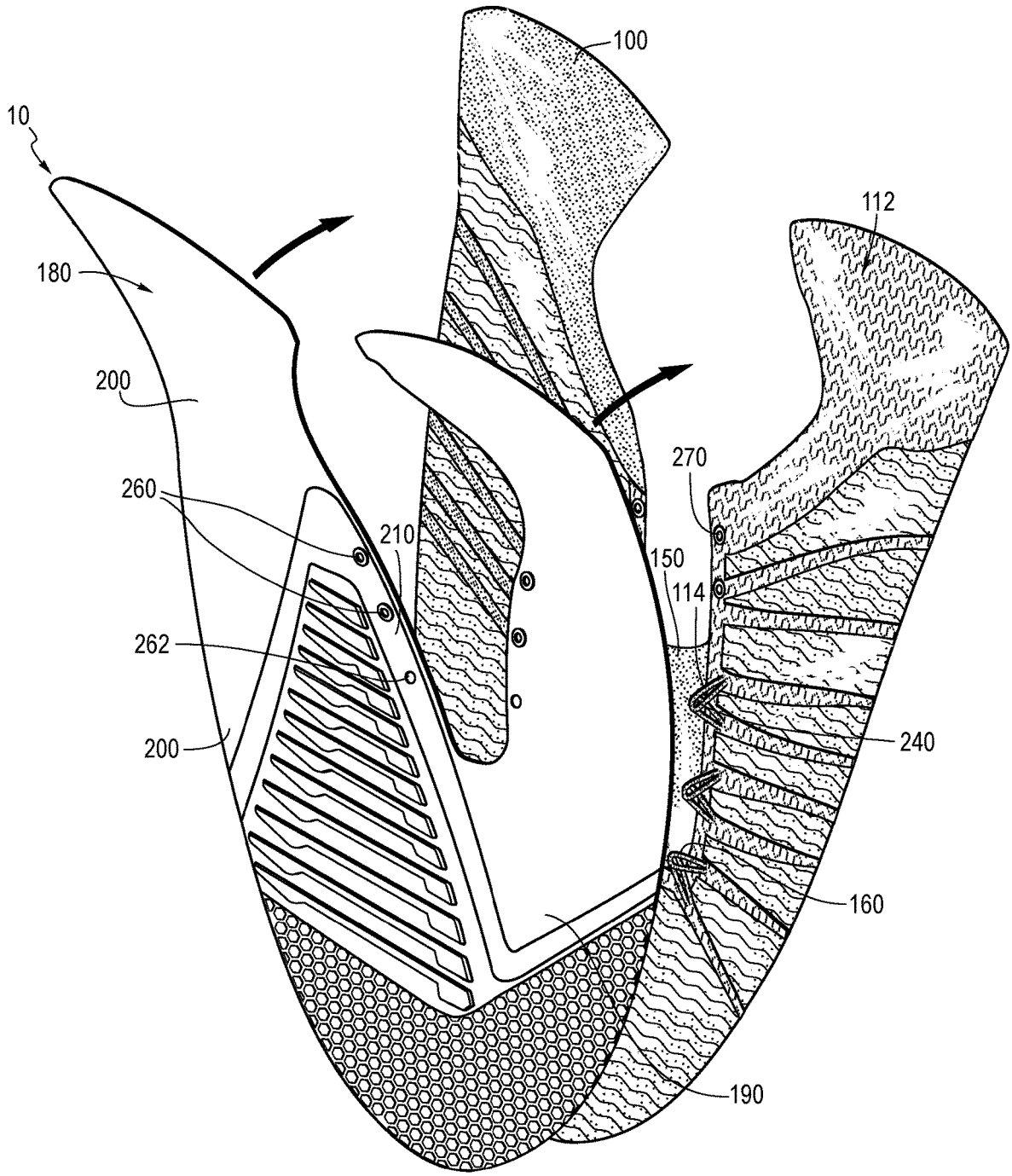
FIG. 4 is an illustration showing at exploded view of the inner component and the outer shroud.

FIG. 4 is an illustration showing an exploded view of the inner component 100 and the outer shroud 110 (when they are not formed integrally on a knitting machine). Referring to FIG. 4, in the completed upper, the outer shroud 110 is positioned against the second surface 112 of the inner component 100 such that the outer shroud 110 forms an outer surface 180 of the upper 10. The outer shroud 110 includes an outer medial region 190 and an outer lateral region 200. Notably, the outer shroud 110 may optionally include some knit areas (e.g., outer lateral region) and other non-knit areas (e.g., the outer medial region 190) to optimize surface characteristics on different areas of the article of footwear. An outer throat region 210 occupies a proximal portion of the outer medial region 190. The outer shroud 110 may at least partially cover inner throat region 150 of the inner component 100. In this way, the inner component 100 is positioned against the outer shroud 110 so that the loops 114 formed by the tensile strand 160 are located between the inner component 100 and the outer shroud 110. For example, the loops 114 may be located in a pocket in the throat area, where the pocket is formed by coextensive layers (i.e., the inner component 100 and the outer shroud 110). The outer shroud 110 and the inner component 100 of the upper 10 may be attached to a sole to form an article of footwear 20, as depicted in FIG. 1 and FIG. 2.

Figure 5:
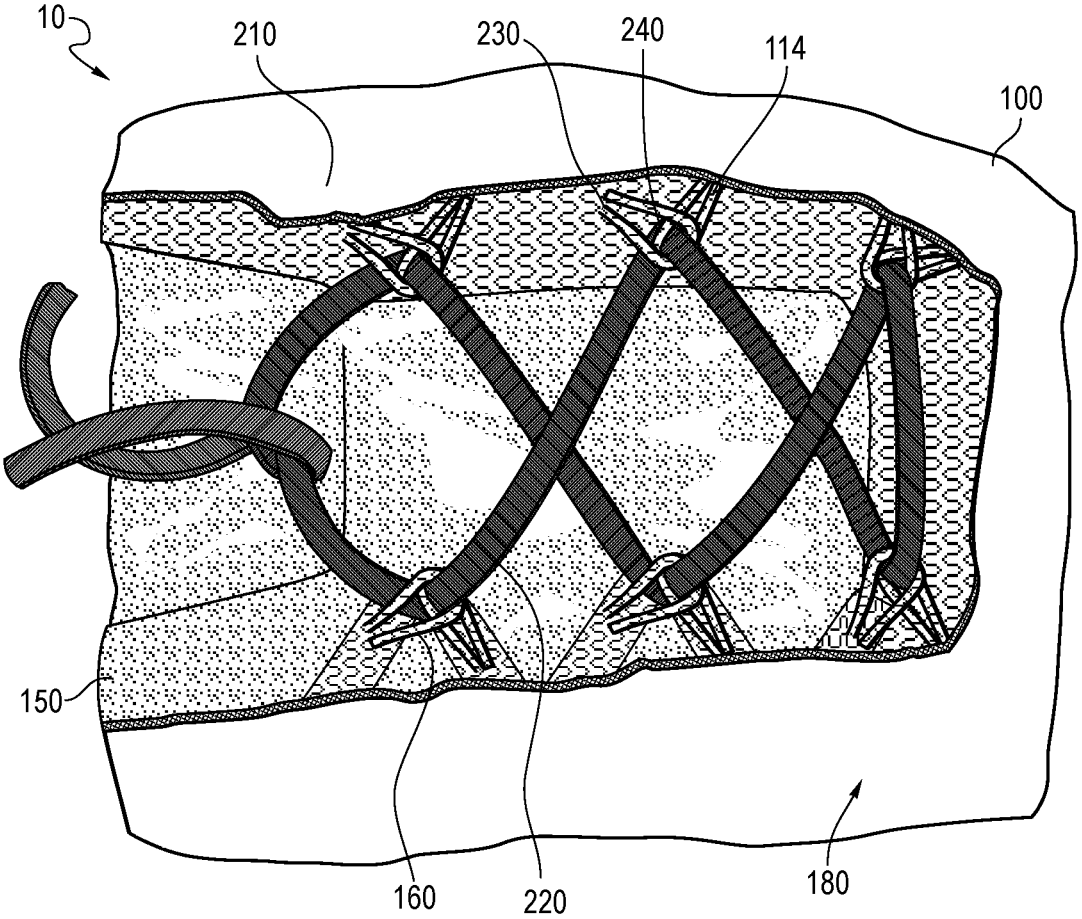
FIG. 5 is an illustration showing a section of an inner throat region of the inner component with visible loops and a shoe-fastening element.

Referring to FIGS. 4-5, the loops 114 formed by the tensile strands 160, which may be situated between the inner and outer throat regions 150, 210, may be sized, shaped, positioned, and/or otherwise configured to receive a shoe-fastening element 220 (shown in FIG. 5). The fastening element 220 may include, but is not limited to, a shoelace, a strap, an elastic band, or a drawstring, or any other suitable device that is configured to adjust the geometry of the upper upon application of a force or other input action. The fastening element 220 may be positioned between the outer shroud 110 and inner component 100 such that the fastening element 220 is at least partially obscured by the outer shroud 110 (from an external perspective, as depicted in FIG. 1).

In some embodiments, referring to FIG. 5, two loops 114 of the plurality of loops 114 are configured to overlap to form a single lacing loop eyelet 230. This is advantageous because the fastening element 220 may be secured with two loops 114 at a fastening point 240. By having at least two loops 114 at a fastening point 240, there is built in redundancy in case one of the loops 114 breaks, allowing the remaining loop 114 to support the fastening element 220 without significantly changing the fit of the inner component 100. This redundancy can be advantageous as the fastening element 220 is at least partially obscured by the outer shroud 110, complicating any repair or replacement activities. Additionally, by using at least two separate loops 114 to form a single lacing loop eyelet 230, the shoe-fastening element 220 may interact with multiple tensile strands 160 extending from the throat area 116 of the upper 10 to the medial and/or lateral biteline 170 (shown in FIG. 1), thus providing an enhanced, snug fit around the foot.

One advantage of the systems described is the covering, or partial covering, of at least one of the loops 114 and/or the shoe-fastening element 220. This feature may result in the upper 10 having a more uniform texture in certain regions of the outer surface 180, such as in the medial region, the lateral region, and/or the throat area 116 where the shoe-fastening element 220 is typically exposed in other articles of footwear. This may affect air flow around the article of footwear 20, decrease the movement of the shoe-fastening element 220 when the article of footwear 20 is in use, provide a more uniform surface in the medial region of the outer surface 180 if using the article of footwear 20 to interact with a ball or sport equipment (e.g., during a kick), provide additional area on the outer surface 180 for aesthetic applications or branding, among other advantages. Additionally, by covering, at least in part, the loop 114 or shoe-fastening element 220, these aspects of the article of footwear 20 are partially protected from some environmental stresses including, but not limited to, UV light from sunlight, wind, particulate, water, soil, and debris. As a result of reducing the amount of contact these environmental irritants have with the loop 114 and shoe-fastening element 220, the loop 114 and shoe-fastening elements 220 may experience a decreased rate of deterioration.

In some embodiments, and as shown in FIGS. 3-5, the inner component 100 and the outer shroud 110 may include respective eyelets 260 and 270. When assembled, the eyelets 260, 270 may be aligned when the upper 10 is assembled such that they are positioned for receiving a lace or other shoe-fastening element. The eyelets 260, 270 may be included in addition to the loop 114 in a different location along the throat of the upper 10, but they may be associated with the same shoe-fastening element. The eyelets 260, 270 may be advantageous for communicating with the shoe-fastening element at a location that is accessible to a user, and also for providing a snug fit near the top of the foot without necessitating a high-degree of rigidity at that location (which may be uncomfortable) as provided by the tensile strands 160 in other locations lower on the foot. Optionally, at least one of the eyelets (in this case the depicted eyelets 262) of the outer shroud 110 may be aligned with certain loops 114, which may be advantageous for aesthetics, shoe-fastening element accessibility, and enhanced fit/comfort (particularly where the outer shroud 110 may move slightly with respect to the inner component 100 during wear.

In some embodiments, the outer throat region 210 may have an elasticity that is higher than an elasticity the lateral region of the shroud, and the inner throat region 150 may have an elasticity that is higher than the elasticity of the lateral region of the inner component 100. This may be advantageous for providing rigidity, for structural integrity, of the medial and lateral sides (e.g., for providing desirable characteristics for use when a user makes lateral movements during athletic competition), while proving an elastic throat area to facilitate variable fit around the foot. The relatively high inner and outer throat region 210 elasticity may be provided using elastomeric materials, such as polyurethane containing polymer, spandex, lycra, polyester or polyether polyols that allow the region to stretch and then recover to its original shape, and/or by using certain knitting or other manufacturing techniques that impart a high elasticity into textiles (for example). In some embodiments, a material forming of the inner and outer throat regions of the outer shroud 110 may be may elongate at least twice as much as the elongation of the tensile strand 160 when subjected to the same tensile force (e.g., such as a 5 pound force applied on a tensometer). Put another way, the Young's modulus of the tensile strand is at least twice as large as the Young's modulus of the material forming most of the remainder of the upper 10, where the Young's modulus is measured using the ASTM E111 standard test method for a material's Young's Modulus, measuring the rate of change of strain as a function of tensile stress. Alternatively, the relatively high elasticity of the inner and outer throat regions 150, 210 may be the function using a knit, folded, or ridged structure that allows for additional regional elasticity or some combination using structure and elastomeric materials.

One advantage of the systems described is that the relatively high elasticity in the inner and outer throat regions 150, 210 allows the upper 10 to stretch to accommodate a wearer's foot as it enters the void without the use of separate tongue pieces. By removing the need for a tongue piece, the upper 10 may have a more streamlined appearance and shape. Additionally, by removing the need for the tongue, only a single, uninterrupted inner surface 120 of the upper 10 comes in contact with the wearer's foot, increasing wearer comfort.

Optionally, and referring to FIG. 2, the outer shroud 110 may include a variety of protrusions 250 (or other texture-providing feature) located on the outer surface 180 of the outer shroud 110. While the protrusions may be formed as thermoplastic features (e.g., that are adhered to the outer surface 180 of the outer shroud 110 via heat-processing) or other features that are attached to the outer surface 180 (with a chemical adhesive, a stable or other mechanical or fastener, etc.), they may alternatively take any other suitable form. For example, if the outer shroud 110 is knitted, they may be knit-formed features, such as ribs or welts formed by a knitting process. However, in the depicted embodiment, the protrusions 250 are adhered to the outer surface 180 of the outer shroud 110, imparting a desirable texture or design to the upper 10. It is contemplated that the outer surface 180 may be a surface specifically designed for receipt of the protrusions 250. For example, the outer surface 180 may be a knit or non-knit surface (e.g., a surface including a thermoplastic polymer material for adherence) that secures to the protrusions 250 with an enhanced durability relative to other embodiments. In some examples, the protrusions 250 may have a web-like structure. In other examples the protrusion 250 may be a film or laminate layer. In other examples the protrusions 250 may be a textured shape. The protrusions 250 may have a variety of material and structural properties which it imparts to the portion of the outer surface 180 feature that may include, but are not limited to, water resistance, reflectivity, non-slip texture, cushioning, tensile strength, rigidity, among others. Additionally, the protrusions 250 may affect airflow or liquid flow around the upper 10.

While various embodiments have been described, the embodiments herein are not limiting and it will be apparent to those of ordinary skill in the art that many more embodiments and implementations are possible within the scope of the present disclosure. Accordingly, the present disclosure is not to be restricted. Various modifications and changes may be made within the scope of the attached claims.

We claim:

1. An upper for an article of footwear, the upper comprising:

a medial side, a lateral side, and a throat area between the medial side and the lateral side;

an inner component forming an inner surface of the upper, wherein the inner component includes an inner throat region in the throat area, wherein at least one tensile strand of the inner component forms at least one loop in the inner throat region, and wherein the at least one loop includes an opening;

an outer shroud forming an outer surface of the upper, wherein the outer shroud includes at least one eyelet located at one or more of an outer medial region and an outer lateral region of the outer shroud, wherein the outer shroud at least partially covers the inner throat region of the inner component such that the at least one loop is entirely maintained in a pocket formed between the inner component and the outer shroud, and wherein an outer throat region of the outer shroud has an elasticity that is higher than an elasticity of the outer medial region and the outer lateral region of the outer shroud; and a fastening element that extends through the opening of the at least one loop and further extends through the at least one eyelet located at the one or more of the outer medial region and the outer lateral region of the outer shroud.

2. The upper of claim 1, wherein the fastening element is configured to adjust a geometry of the upper.

3. The upper of claim 1, wherein the at least one loop is exposed with respect to a second surface of the inner component, the second surface facing opposite the inner surface.

4. The upper of claim 1, wherein the at least one loop comprises at least two loops, and wherein the at least two loops overlap to form a single opening for receipt of the fastening element.

5. The upper of claim 1, wherein at least one of the inner component and the outer shroud is a knitted component.

6. The upper of claim 1, wherein the inner component is a knitted component, and wherein the at least one tensile strand is inlaid within the knitted component such that it extends through at least one course in a course-wise direction.

7. The upper of claim 1, wherein the outer shroud includes a protrusion located on the outer surface of the outer shroud.

8. The upper of claim 7, wherein the outer shroud includes a non-knit surface configured to receive the protrusion.

9. The upper of claim 1, wherein a Young's modulus for the at least one tensile strand is at least twice a Young's modulus for the outer throat region of the outer shroud.

10. The upper of claim 1, wherein the at least one tensile strand extends from the at least one loop to a bite line of the upper.

11. The upper of claim 1, wherein the inner component includes at least one eyelet, and wherein the at least one eyelet of the inner component is aligned with the at least one eyelet of the outer shroud.

12. The upper of claim 11, wherein the at least one eyelet of the inner component is configured to receive the fastening element.

13. An upper for an article of footwear, the upper comprising:

an inner component forming an inner surface of the upper, wherein the inner component includes an inner throat region in a throat area of the upper, and wherein the inner component includes at least one opening; and an outer shroud forming an outer surface of the upper, wherein the outer shroud includes at least one eyelet located at one or more of an outer medial region and an outer lateral region of the outer shroud, wherein the outer shroud at least partially covers the inner throat region of the inner component such that a pocket is formed between the inner component and the outer shroud, wherein the at least one opening of the inner component is entirely maintained within the pocket, and wherein an outer throat region of the outer shroud has an elasticity that is higher than an elasticity of the outer medial region and the outer lateral region of the outer shroud; and a fastening element that extends through the at least one opening of the inner component and further extends through the at least one eyelet located at the one or more of the outer medial region and the outer lateral region of the outer shroud.

14. The upper of claim 13, wherein the at least one opening is formed from a loop of a tensile strand extending through at least one of the inner component and the outer shroud.

15. The upper of claim 13, wherein at least one of the inner component and the outer shroud is a knitted component.

16. The upper of claim 15, wherein the at least one opening is formed by a tensile strand that is an inlaid strand extending through the knitted component such that the tensile strand extends through at least one course in a course-wise direction.

17. A method, comprising:

knitting intermeshed loops of an inner component of an upper, wherein the inner component forms an inner surface of the upper, and wherein the inner component includes an inner throat region in a throat area of the upper;

inlaying a tensile strand between loops of the inner component, wherein the inner component forms a loop in the inner throat region that forms an opening;

securing an outer shroud to the inner component, wherein the outer shroud includes at least one eyelet located at one or more of an outer medial region and an outer lateral region of the outer shroud, wherein the outer shroud forms an outer surface of the upper, wherein the outer shroud least partially covers the inner throat region of the inner component such that the opening is entirely maintained in a pocket formed between the inner component and the outer shroud, and wherein an outer throat region of the outer shroud has an elasticity that is higher than an elasticity of the outer medial region and the outer lateral region of the outer shroud; and deploying a fastening element such that it extends through the opening of the at least one loop and further extends through the at least one eyelet located at the one or more of the outer medial region and the outer lateral region of the outer shroud.

* * * * *